US010859095B2

(12) United States Patent
Arai et al.

(10) Patent No.: US 10,859,095 B2
(45) Date of Patent: Dec. 8, 2020

(54) IMPELLER AND AXIAL FLOW FAN

(71) Applicant: MITSUBISHI ELECTRIC CORPORATION, Tokyo (JP)

(72) Inventors: Toshikatsu Arai, Tokyo (JP); Chikage Kadoi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/081,139

(22) PCT Filed: Jun. 16, 2016

(86) PCT No.: PCT/JP2016/068002
§ 371 (c)(1),
(2) Date: Aug. 30, 2018

(87) PCT Pub. No.: WO2017/216937
PCT Pub. Date: Dec. 21, 2017

(65) Prior Publication Data

US 2019/0107118 A1 Apr. 11, 2019

(51) Int. Cl.
*F04D 29/38* (2006.01)
*F01D 5/14* (2006.01)
*F04D 29/32* (2006.01)

(52) U.S. Cl.
CPC ..... *F04D 29/386* (2013.01); *F01D 5/141* (2013.01); *F04D 29/325* (2013.01); *F04D 29/384* (2013.01); *F05D 2240/307* (2013.01)

(58) Field of Classification Search
CPC .... F04D 29/324; F04D 29/325; F04D 29/384; F04D 29/386; F01D 5/141
See application file for complete search history.

(56) References Cited

U.S. PATENT DOCUMENTS 4,893,990 A * 1/1990 Tomohiro ..... F04D 29/281 416/228
6,994,523 B2 * 2/2006 Eguchi ..... F04D 29/384 416/228

(Continued)

FOREIGN PATENT DOCUMENTS

CN 1629498 A 6/2005
JP 2003148395 A 5/2003

(Continued)

OTHER PUBLICATIONS

Office Action (Notice of Reasons for Refusal) dated May 7, 2019, by the Japanese Patent Office in corresponding Japanese Patent Application No. 2018-523129 and English translation of the Office Action. (7 pages).

(Continued)

*Primary Examiner* — Courtney D Heinle
*Assistant Examiner* — Michael K. Reitz
(74) *Attorney, Agent, or Firm* — Buchanan Ingersoll & Rooney PC

(57) ABSTRACT

An impeller includes: a boss portion driven to rotate by a motor; and a plurality of rotating blades projecting radially from the boss portion in a direction in which a diameter increases from a rotational axis of the motor and generating airflow in an axial direction of the rotational axis. The rotating blades have an S-shaped radial cross section in which an inner peripheral side portion is protruded with respect to the airflow and an outer peripheral side portion is recessed with respect to the airflow, and a recess-shaped portion of the rotating blades has a distribution of a radius of curvature value such that the radius of curvature value gradually decreases toward a blade trailing edge portion from a blade leading edge portion and a rate of the gradual (Continued)

reduction becomes smaller toward the blade trailing edge portion.

9 Claims, 12 Drawing Sheets

(56) References Cited

U.S. PATENT DOCUMENTS

| | | | | |
|---|---|---|---|---|
| 7,824,154 | B2 * | 11/2010 | Yabuuchi | F04D 25/0613 415/211.2 |
| 9,816,521 | B2 * | 11/2017 | Kumon | F04D 29/384 |
| 2010/0158677 | A1 | 6/2010 | Ishihara | |
| 2013/0045107 | A1 * | 2/2013 | Topaz | B63H 1/26 416/243 |
| 2020/0116159 | A1 * | 4/2020 | Yang | F04D 29/384 |

FOREIGN PATENT DOCUMENTS

| | | | |
|---|---|---|---|
| JP | 2008255966 | A | 10/2008 |
| JP | 2010-144702 | A | 7/2010 |
| JP | 4680840 | B2 | 2/2011 |
| JP | 2011-179330 | A | 9/2011 |

OTHER PUBLICATIONS

Extended European Search Report dated Apr. 25, 2019, issued by the European Patent Office in corresponding European Application No. 16905492.1. (6 pages).

International Search Report (PCT/ISA/210) dated Aug. 16, 2016, by the Japanese Patent Office as the International Searching Authority for International Application No. PCT/JP2016/068002.

Office Action dated Nov. 5, 2019, issued in corresponding Japanese Patent Application No. 2018-523129 , 5 pages including 3 pages of English machine translation.

Office Action dated Nov. 28, 2019, issued in corresponding Chinese Patent Application No. 201680084861.X, 12 pages including 5 pages of English translation.

Office Action dated Mar. 27, 2020, by the Indonesian Patent Office in corresponding Indonesian Patent Application No. P00201810232 and English translation of the Office Action. (4 pages).

* cited by examiner

IMPELLER AND AXIAL FLOW FAN

FIELD

The present invention relates to an impeller and an axial flow fan that are used in a ventilator and an air conditioner.

BACKGROUND

For the main purpose of reducing noise, the rotating blades of impellers for axial flow fans are shaped to sweep forward in a rotational direction and are inclined forward toward the suction upstream side. In recent years, to further reduce noise, a rotating blade has been proposed that has a shape that can reduce interference with blade tip vortices, i.e., a shape in which the blade outer peripheral portion is bent toward the airflow upstream side. When blades rotate, leakage flow occurs at the blade outer peripheral portions in such a manner that air on the pressure side flows around the blade outer peripheral portion to the suction side due to the pressure difference between the pressure side and the suction side of the rotating blade. A blade tip vortex is thus generated on the blade suction side due to this leakage flow and the generated blade tip vortex interferes with the pressure face, the adjacent rotating blade, or the bell mouth. This may cause an increase in noise. The shape described above has been proposed to address such a problem.

There is a known conventional blade-tip-vortex control method in which the area along the blade chord central line is divided into two areas, i.e., an area closer to the boss portion and an area closer to the blade outer periphery. The area closer to the boss portion is inclined toward the upstream side at a forward tilt angle larger than 0°. The area closer to the blade outer peripheral portion is inclined toward the upstream side at a forward tilt angle larger than the forward tilt angle defined for the boss portion area (for example, see Patent Literature 1).

CITATION LIST

Patent Literature

Patent Literature 1: Japanese Patent No. 468040

SUMMARY

Technical Problem

The conventional technology described above reduces noise by controlling blade tip vortices and preventing an increase in the noise due to the blade tip vortices by having a shape in which the blade outer peripheral portion is bent toward the airflow upstream side. Employing a shape in which the blade outer peripheral portion is bent toward the airflow upstream side to control blade tip vortices however increases airflow leakage. In particular, when a static pressure is being applied, the airflow leakage causes the static pressure to fall; therefore, the fan efficiency tends to decrease.

To reduce noise and prevent a reduction in static pressure, a shape has been proposed in which the radial cross-sectional shape of a rotating blade is divided into an inner peripheral side portion and an outer peripheral side portion. The inner peripheral side portion has a shape such that airflow leakage does not occur easily, and the outer peripheral side portion is bent toward the upstream side so that the blade tip vortices can be controlled. However, because the condition of a blade tip vortex generated at the blade outer peripheral side portion changes from the leading edge toward the trailing edge of the rotating blade, this shape is not optimal with regard to the change of the blade tip vortex. This means that this technology has room for further reducing noise and improving efficiency.

The present invention has been made in view of the above, and an object of the present invention is to provide an impeller that reduces an increase in noise and reduces a reduction in efficiency due to the change of a blade tip vortex.

Solution to Problem

In order to solve the above problems and achieve the object, in an aspect of the present invention, an impeller includes: a boss portion driven to rotate by a motor; and a plurality of rotating blades projecting radially from the boss portion in a direction in which a diameter increases from a rotational axis of the motor and generating airflow in an axial direction of the rotational axis, and the rotating blades each have an S-shaped radial cross section in which an inner peripheral side portion is protruded with respect to the airflow and an outer peripheral side portion is recessed with respect to the airflow. In an aspect of the present invention, a recess-shaped portion of the rotating blades has a distribution of a radius of curvature value such that the radius of curvature value gradually decreases toward a blade trailing edge portion from a blade leading edge portion and a rate of the gradual reduction becomes smaller toward the blade trailing edge portion.

Advantageous Effects of Invention

An impeller according to the present invention has an effect where it is possible to reduce an increase in noise and reduce a reduction in efficiency due to the change of a blade tip vortex.

DESCRIPTION OF EMBODIMENTS

An axial flow fan according to embodiments of the present invention will be described below in detail with reference to the drawings. The embodiments are not intended to limit the present invention.

First Embodiment

Figure 1:
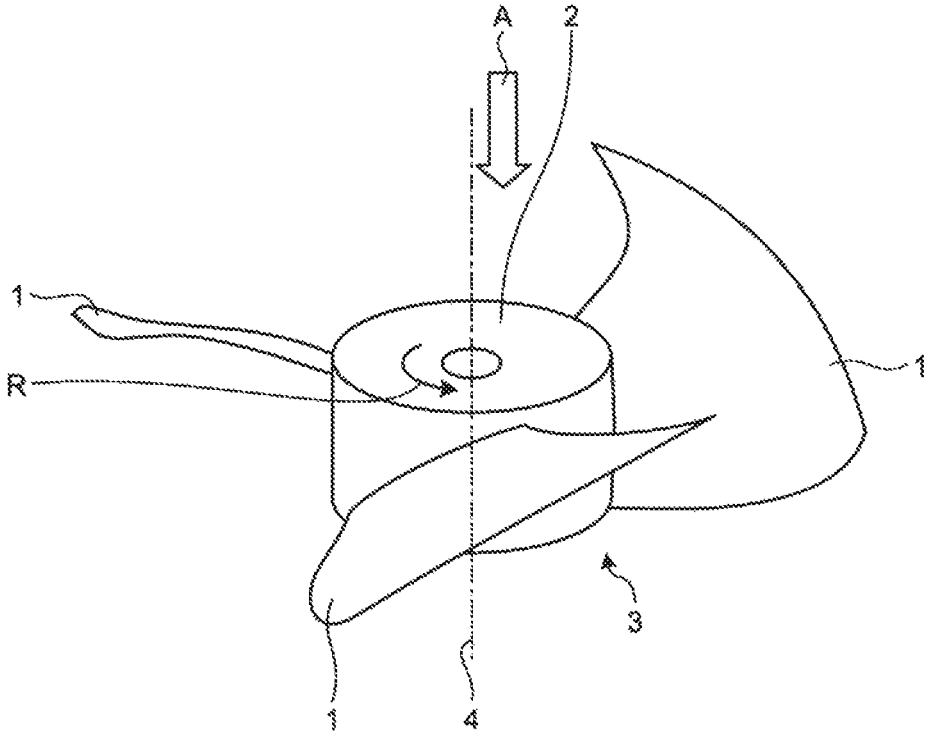
FIG. 1 is a perspective view illustrating an impeller according to a first embodiment of the present invention.
Figure 2:
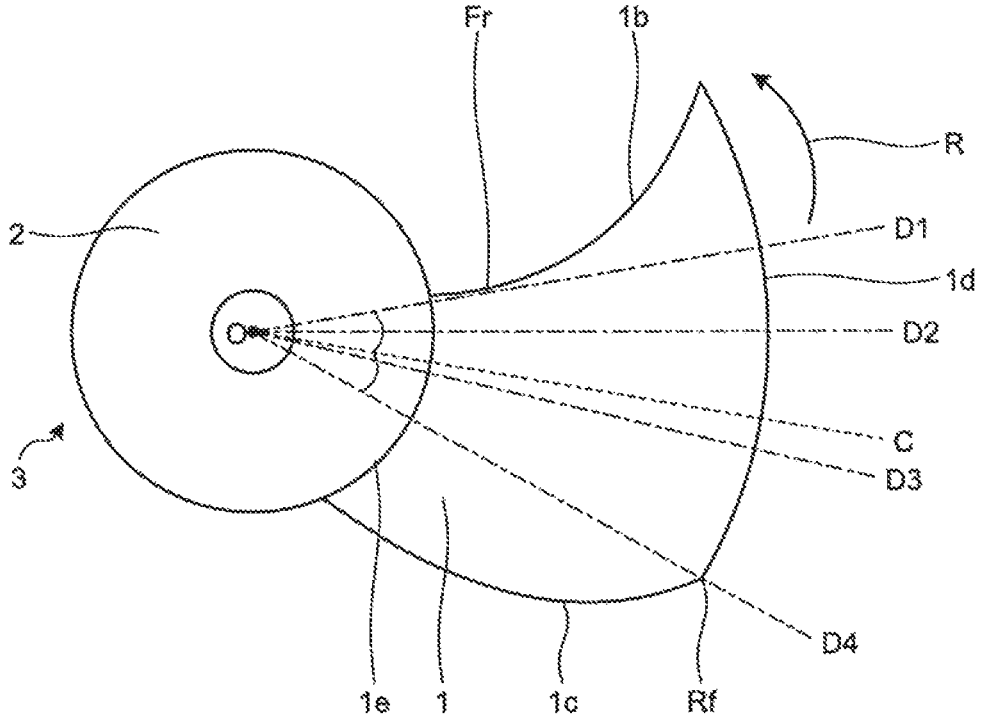
FIG. 2 is a plan view of a rotating blade of the impeller according to the first embodiment.
Figure 3:
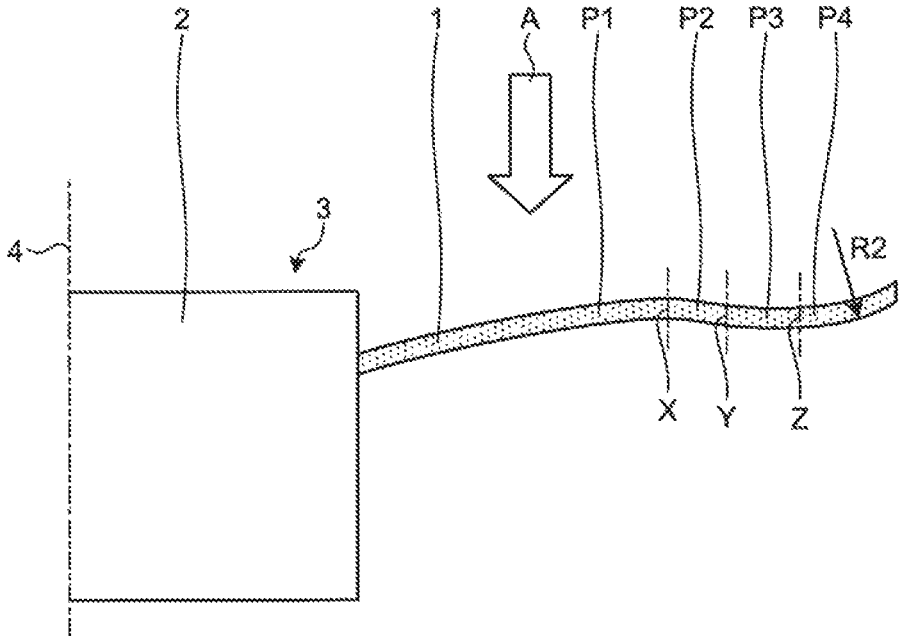
FIG. 3 is a cross-sectional view of the rotating blade of the impeller according to the first embodiment.

FIG. 1 is a perspective view illustrating an impeller according to a first embodiment of the present invention. FIG. 2 is a plan view of a rotating blade of the impeller according to the first embodiment. FIG. 3 is a cross-sectional view of the rotating blade of the impeller according to the first embodiment. An impeller 3 according to the first embodiment includes a columnar boss portion 2 that is driven by a motor (not illustrated) to rotate about a rotational center O in the direction indicated by an arrow R; and rotating blades 1, each having a three-dimensional shape. The rotating blades 1 are radially attached to the outer periphery of the boss portion 2. Rotation of the impeller 3 causes the rotating blades 1 to generate airflow in the direction indicated by an arrow A. As illustrated in FIG. 1, the impeller 3 according to the first embodiment includes three blades; however, the number of the rotating blades 1 of the Impeller 3 may be any number that is greater than one and is other than three. Hereinafter, only one of the rotating blades 1 will be described as a representation; however, all the rotating blades 1 have the same shape.

As illustrated in FIG. 3, in the radial cross section, the rotating blade 1 of the impeller 3 according to the first embodiment has a convex shape against the direction of the airflow on the side closer to the boss portion 2 and has a concave shape in the direction of the airflow on the side closer to the outer peripheral portion. This means that the rotating blade 1 has an S-shaped cross section in which the inner peripheral side portion protrudes with respect to the airflow and the outer peripheral side portion is recessed with respect to the airflow. In the following descriptions, an inner convex portion P1 indicates a portion between a blade inner peripheral portion 1*e* present on the inner peripheral side of the rotating blade 1 and a vertex X of the S-shaped portion on the inner peripheral side; an inner switching portion P2 indicates a portion between the vertex X of the S-shaped portion on the inner peripheral side and a switching point Y of the convex and the concave; an outer switching portion P3 indicates a portion between the switching point Y of the convex and the concave and the vertex Z of the S-shaped portion on the outer peripheral side; and an outer concave portion P4 indicates a portion between the vertex Z of the S-shaped portion on the outer peripheral side and a blade outer peripheral portion 1*d*. The inner convex portion P1 and the outer concave portion P4 are smoothly connected to each other by the inner switching portion P2 and the outer switching portion P3.

Figure 4:
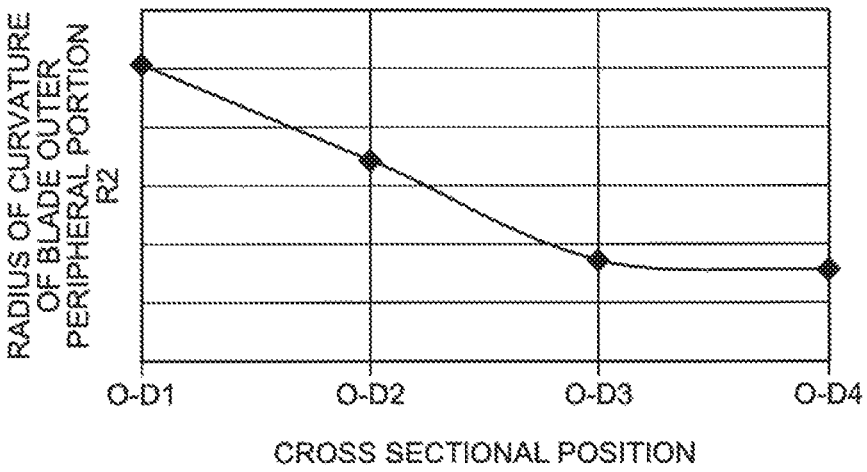
FIG. 4 is a graph illustrating the change of the radius of curvature value of an outer concave portion of the rotating blade of the impeller according to the first embodiment.

The outer concave portion P4 of the rotating blade 1 has a distribution of a radius of curvature value R2 such that it gradually decreases toward a blade trailing edge portion 1*c* from a blade leading edge portion 1*b*. FIG. 4 is a graph illustrating the change of the radius of curvature value of the outer concave portion of the rotating blade of the impeller according to the first embodiment. As illustrated in FIG. 4, the outer concave portion P4 of the rotating blade 1 has a distribution of the radius of curvature value R2 such that it gradually decreases toward the blade trailing edge portion 1*c* from the blade leading edge portion 1*b* and the rate of the gradual reduction becomes smaller toward the blade trailing edge portion 1*c*.

Figure 5:
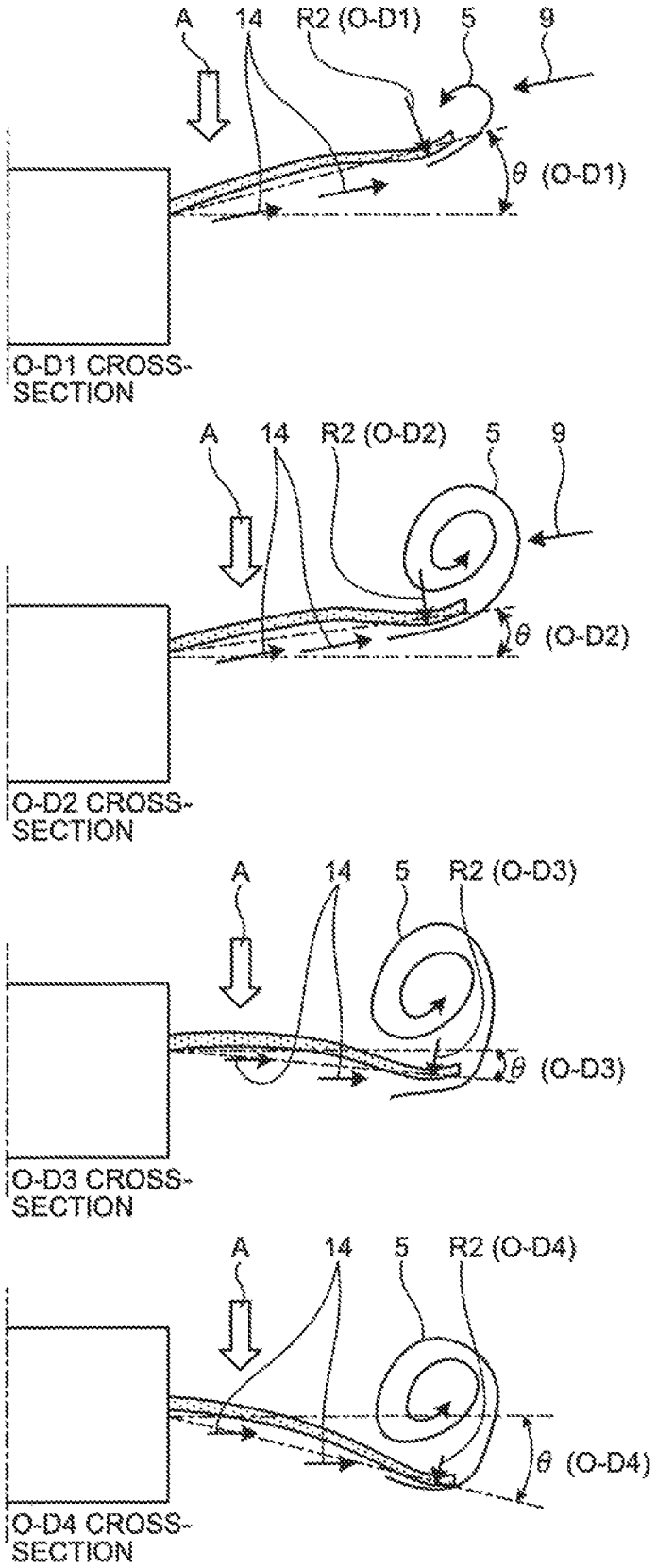
FIG. 5 illustrates schematic diagrams of the radial cross-sectional shapes of the blade of the impeller according to the first embodiment, blade tip vortices, and radial flows.

FIG. 5 illustrates schematic diagrams of the radial cross-sectional shapes of the blade of the impeller according to the first embodiment. FIG. 5 further schematically illustrates blade tip vortices and radial flows. FIG. 5 illustrates the blade shape in each of the cross sections taken along lines O-D1, O-D2, O-D3, and O-D4 in FIG. 2. The line O-D1 is obtained by extending a line connecting the rotational center O and a rearward end Fr of the blade leading edge to the blade outer peripheral portion 1*d*. The line O-D4 is a line connecting the rotational center O and a forward end Rf of the blade trailing edge. With the rotating blade 1 of the impeller according to the first embodiment, in the O-D1 cross-section and the O-D2 cross-section, which are on the side closer to the blade leading edge portion 1*b* than a blade center C, because a traverse auction flow 9 from the blade outer peripheral portion 1*d* is taken into consideration as well, as illustrated in FIG. 5, the rotating blade 1 on the side closer to the blade leading edge portion 1*b* is entirely inclined toward the upstream side of the airflow A to form angles θ(O-D1) degrees and θ(O-D2) degrees toward the upstream side of the airflow with respect to the direction in which the diameter increases from a rotational axis 4. Consequently, the rotating blade 1 has, on the side closer to the blade leading edge portion 1*b* than the blade center C, a shape that can deal with the traverse suction flow 9. The blade center C is located on the bisecting line of the angle formed by the line connecting the rearward end. Fr of the blade leading edge and the rotational center O and the line connecting the forward end Rf of the blade trailing edge and the rotational center O. Further, with the rotating blade 1, to control a blade tip vortex 5 and prevent leakage of a pressure-raised flow, in the O-D3 cross-section and the O-D4 cross-section, which are on the side closer to the blade trailing edge portion 1*c* than the blade center C, the rotating blade 1 is inclined toward the airflow downstream side to form angles θ(O-D3) degrees and θ(O-D4) degrees toward the downstream side of the airflow with respect to the direction in which the diameter increases from the rotational axis 4. Consequently, the rotating blade 1 is shaped such that, on the side closer to the blade trailing edge portion is than the blade center C, a flow 14 flowing in the centrifugal direction frit the blade inner peripheral portion 1*e* does not leak. Therefore, a reduction in efficiency can be prevented.

Figure 6:
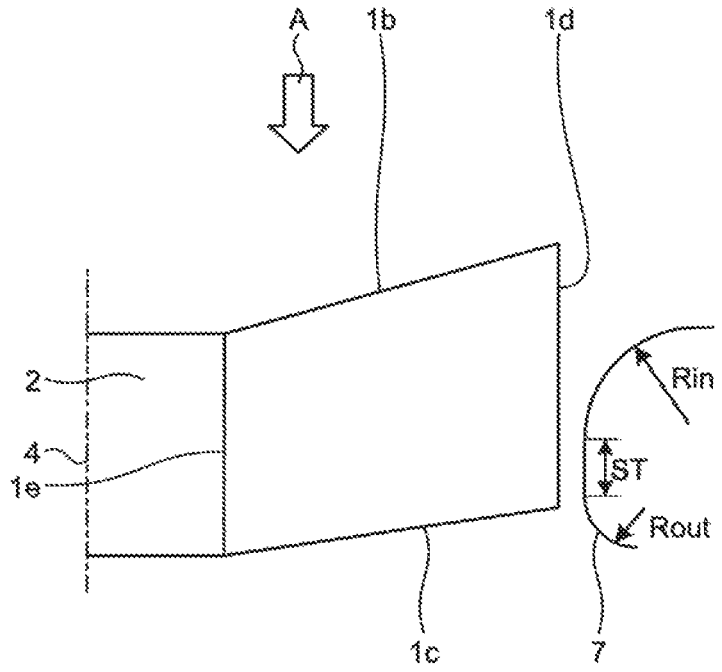
FIG. 6 is a schematic cross-sectional view of an axial flow fan that uses the impeller according to the first embodiment and a half bell mouth.
Figure 7:
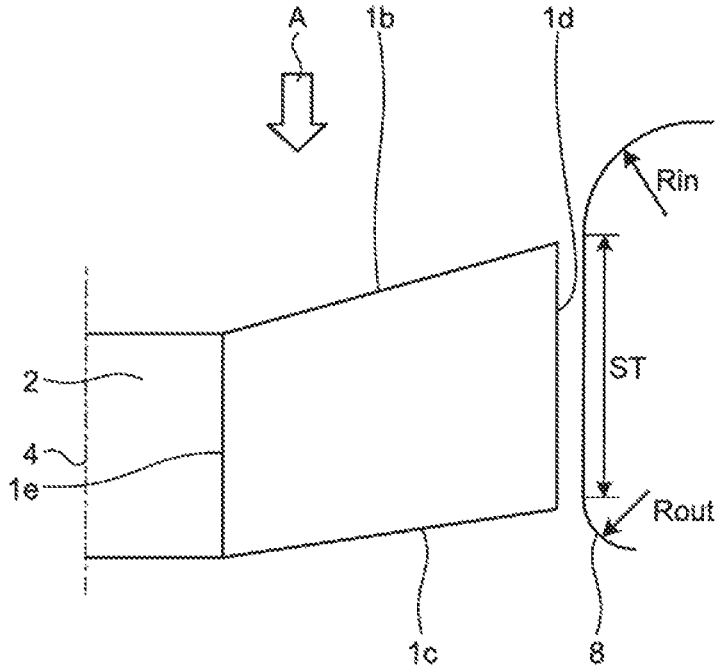
FIG. 7 is a schematic cross-sectional view of an axial flow fan that uses the impeller according to the first embodiment and a full bell mouth.

The impeller 3 according to the first embodiment is used together with a bell mouth so as to configure an axial flow fan. The bell mouth surrounds the impeller 3 to raise the pressure of the airflow and regulate the airflow. FIG. 6 is a schematic cross-sectional view of an axial flow fan that uses the impeller according to the first embodiment and a half bell mouth. A half bell mouth 7 surrounds the rotating blade 1 with the blade leading edge portion 1*b* uncovered at the side. FIG. 7 is a schematic cross-sectional view of an axial flow fan that uses the impeller according to the first embodiment and a full bell mouth. A full bell mouth 8 surrounds the rotating blades 1 such that the full bell mouth 8 covers the blade leading edge portions 1*b* from the side.

Each of the half bell mouth 7 and the full bell mouth 8 includes a auction side curved surface Rin, a cylindrical straight portion ST, and a discharge side curved surface Rout.

Figure 8:
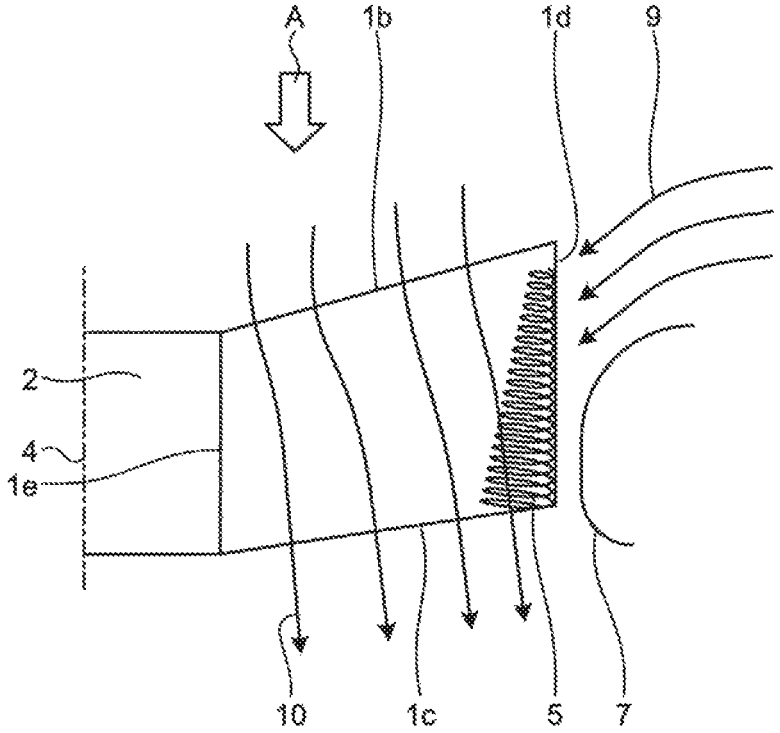
FIG. 8 is a diagram illustrating the distribution of the airflow in the axial flow fan that uses the impeller according to the first embodiment and the half bell mouth.

FIG. 8 is a diagram illustrating the distribution of the airflow in the axial flow fan that uses the impeller according to the first embodiment and the half bell mouth. In the axial flow fan including the half bell mouth 7 illustrated in FIG. 6, the blade leading edge portion 1*b* is substantially uncovered at the side; therefore, the flow flowing to the rotating blade 1 includes not only an intra blade flow 10 flowing from the blade leading edge portion 1*b* toward the blade trailing edge portion 1*c* but also the traverse suction flow 9. Consequently, the blade tip vortex 5 develops significantly from the leading edge of the rotating blade 1. Moreover, the condition of the intra-blade flow changes as the intra-blade flow flows toward the blade trailing edge portion 1*c* from the blade leading edge portion 1*b*; therefore, the condition of the blade tip vortex 5 differs significantly depending on the position in the axial direction.

Figure 9:
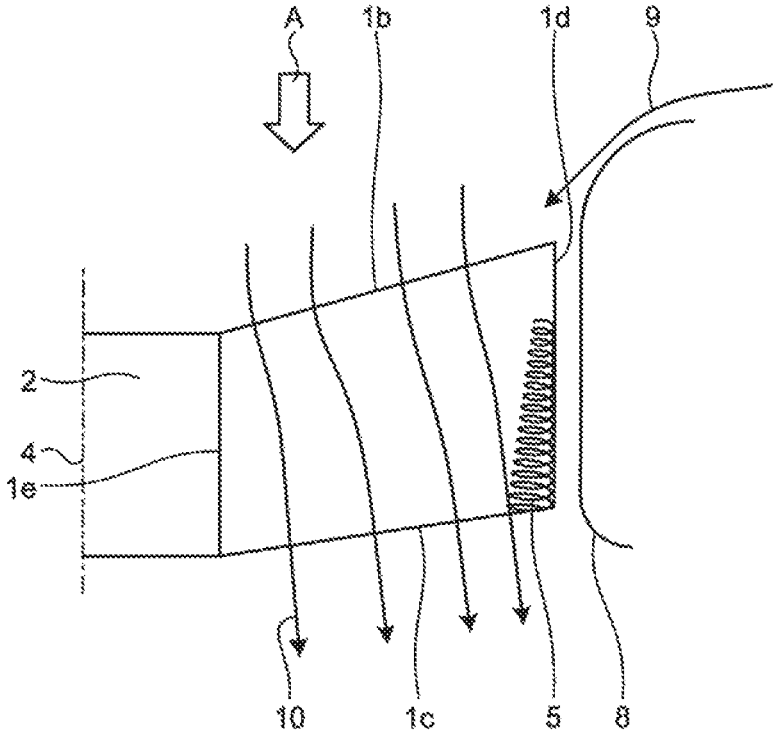
FIG. 9 is a diagram illustrating the distribution of the airflow in the axial flow fan that uses the impeller according to the first embodiment and the full bell mouth.

FIG. 9 is a diagram illustrating the distribution of the airflow in the axial flow fan that uses the impeller according to the first embodiment and the full bell mouth. In the axial flow fan including the full bell mouth 8 illustrated in FIG. 7, the blade leading edge portion 1*b* is substantially covered from the side; therefore, there is almost no traverse suction flow 9 at the blade leading edge portion 1*b* unlike the case with the half bell mouth 7. Consequently, the intra-blade flow 10 makes up the majority of the flow over the rotating blade. Thus, the blade tip vortex 5 does not start to be generated from the blade leading edge portion 1*b* but starts to be generated from a point at which the pressure has risen to a certain degree.

As described above, even when the rotating blades 1 having the same configuration are used, the position at which the blade tip vortex 5 is generated changes depending on the shape of the bell mouth.

Two types of bell mouths, i.e., the half bell mouth 7 and the full bell mouth 8, are in some cases used in a single product. If dedicated rotating blades for respective bell mouths are designed, the cost of the rotating blades becomes double. For this reason, even when the bell mouths having different shapes are used, the same rotating blades are used in some cases. There is therefore a demand for rotating blades that can reduce noise and improve the efficiency irrespective of the shape of the bell mouth.

Figure 10:
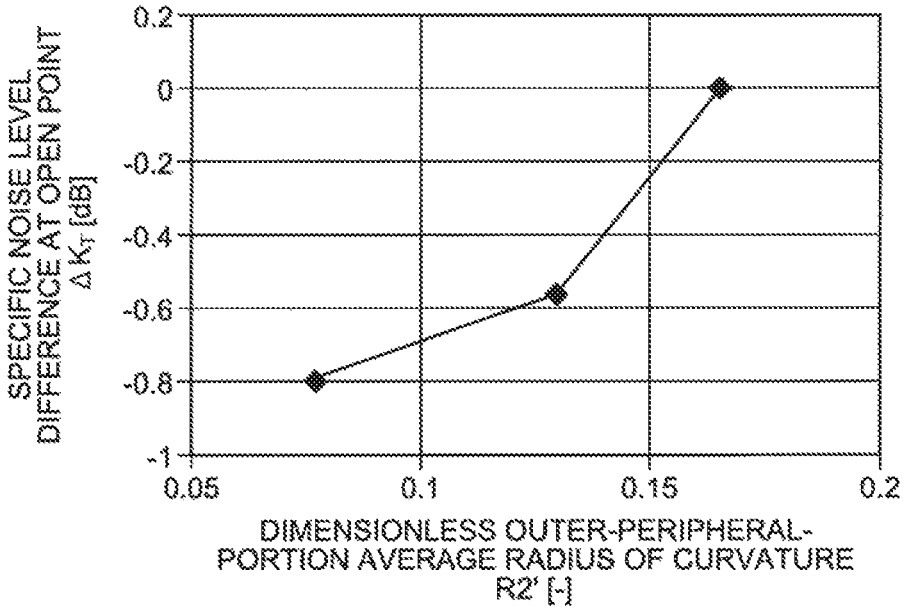
FIG. 10 is a graph illustrating the relationship between the specific noise level difference at an open point and the dimensionless outer-peripheral-portion average radius of curvature of the rotating blade of the axial flow fan that includes the impeller according to the first embodiment and the half bell mouth.
Figure 11:
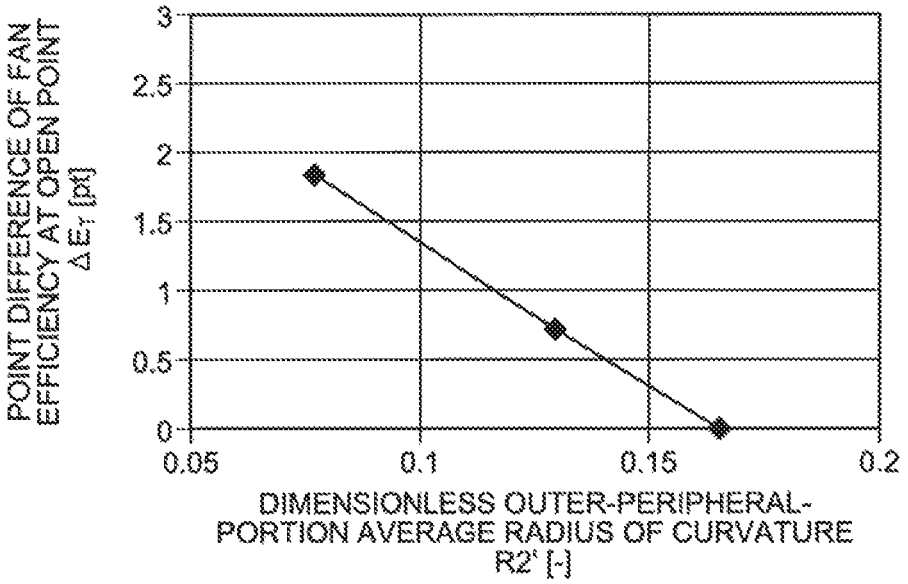
FIG. 11 is a graph illustrating the relationship between the point difference of the fan efficiency at an open point and the dimensionless outer-peripheral-portion average radius of curvature of the rotating blade of the axial flow fan that includes the impeller according to the first embodiment and the half bell mouth.
Figure 12:
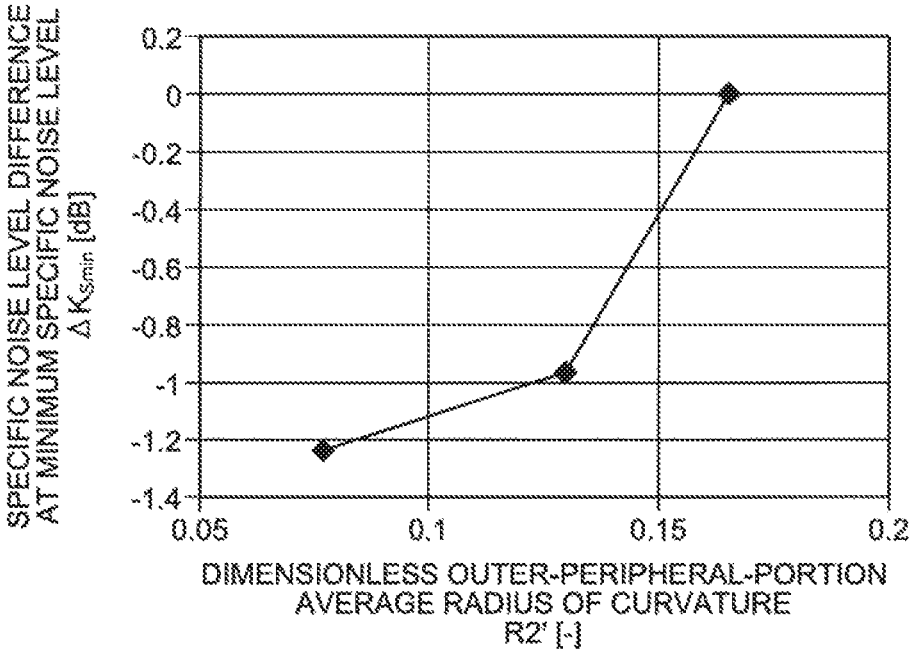
FIG. 12 is a graph illustrating the relationship between the specific noise level difference at a minimum specific noise level and the dimensionless outer-peripheral-portion average radius of curvature of the rotating blade of the axial flow fan that includes the impeller according to the first embodiment and the half bell mouth.
Figure 13:
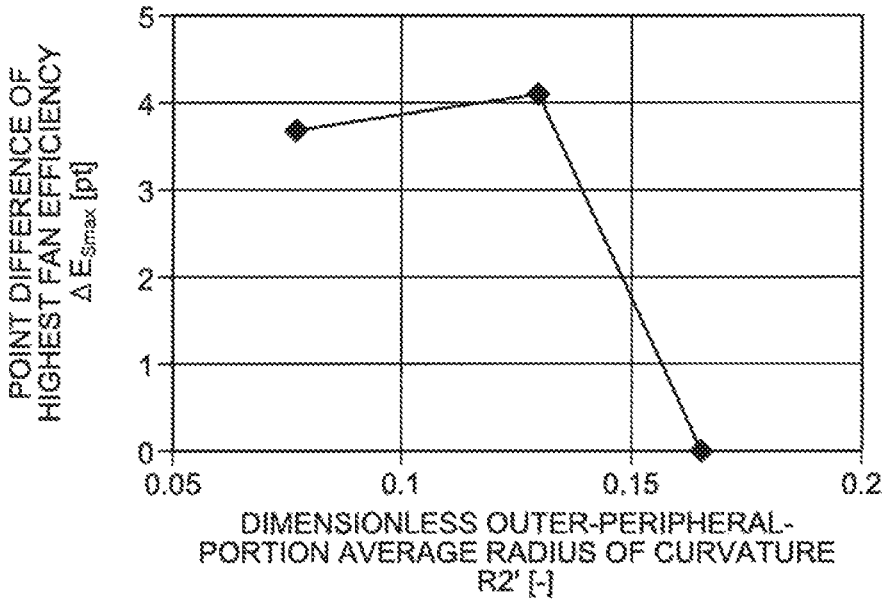
FIG. 13 is a graph illustrating the relationship between the point difference of the highest fan efficiency and the dimensionless outer-peripheral-portion average radius of curvature of the rotating blade of the axial flow fan that includes the impeller according to the first embodiment and the half bell mouth.
Figure 14:
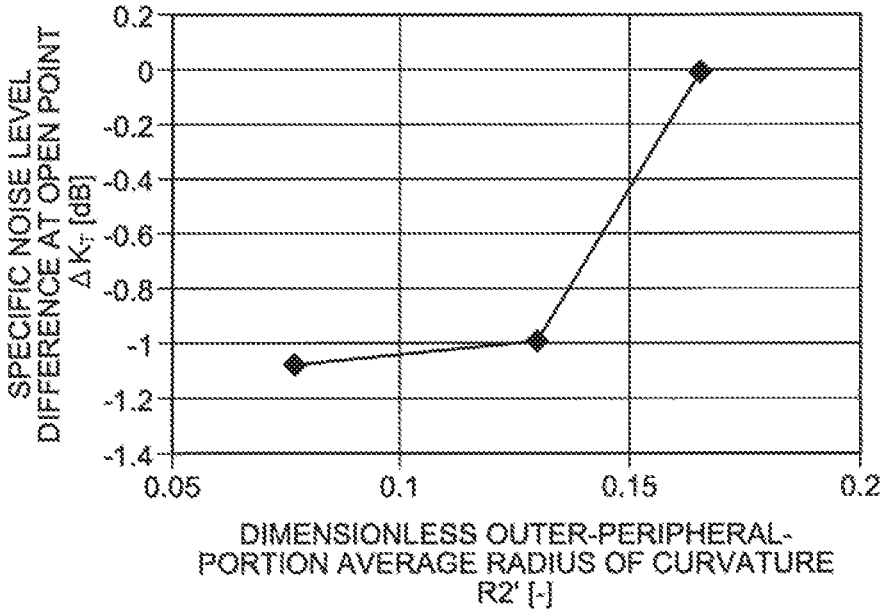
FIG. 14 is a graph illustrating the relationship between the specific noise level difference at an open point and the dimensionless outer-peripheral-portion average radius of curvature of the rotating blade of the axial flow fan that includes the impeller according to the first embodiment and the full bell mouth.
Figure 15:
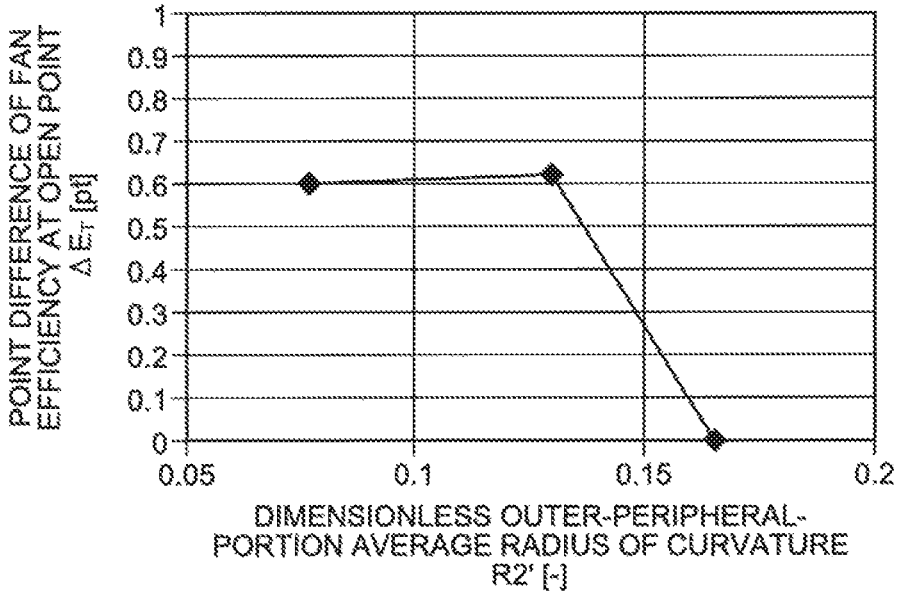
FIG. 15 is a graph illustrating the relationship between the point difference of the fan efficiency at an open point and the dimensionless outer-peripheral-portion average radius of curvature of the rotating blade of the axial flow fan that includes the impeller according to the first embodiment and the full bell mouth.
Figure 16:
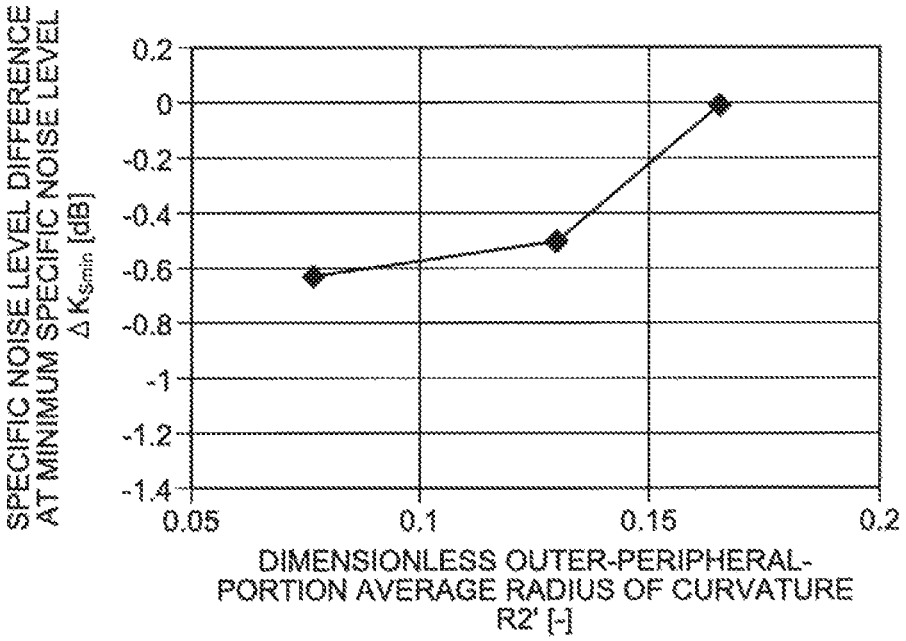
FIG. 16 is a graph illustrating the relationship between the specific noise level difference at a minimum specific noise level and the dimensionless outer-peripheral-portion average radius of curvature of the rotating blade of the axial flow fan that includes the impeller according to the first embodiment and the full bell mouth.
Figure 17:
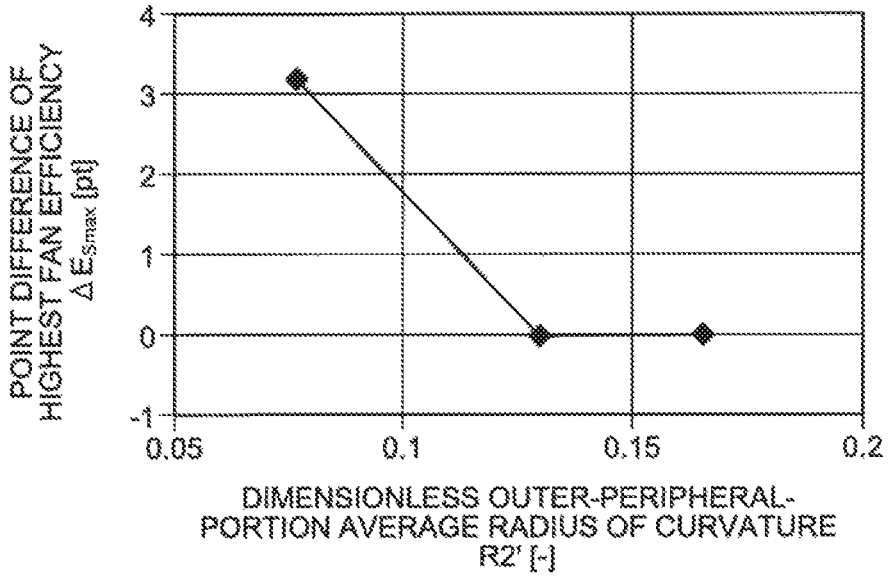
FIG. 17 is a graph illustrating the relationship between the point difference of the highest fan efficiency and the dimensionless outer-peripheral-portion average radius of curvature of the rotating blade of the axial flow fan that includes the impeller according to the first embodiment and the full bell mouth.

FIG. 10 is a graph illustrating the relationship between the specific noise level difference at an open point and the dimensionless outer-peripheral-portion average radius of curvature of the rotating blade of the axial flow fan that includes the impeller according to the first embodiment and the half bell mouth. FIG. 11 is a graph illustrating the relationship between the point difference of the fan efficiency at an open point and the dimensionless outer-peripheral-portion average radius of curvature of the rotating blade of the axial flow fan that includes the impeller according to the first embodiment and the half bell mouth. FIG. 12 is a graph illustrating the relationship between the specific noise level difference at a minimum specific noise level and the dimensionless outer-peripheral-portion average radius of curvature of the rotating blade of the axial flow fan that includes the impeller according to the first embodiment and the half bell mouth. FIG. 13 is a graph illustrating the relationship between the point difference of the highest fan efficiency and the dimensionless outer-peripheral-portion average radius of curvature of the rotating blade of the axial flow fan that Includes the impeller according to the first embodiment and the half bell mouth. FIG. 14 is a graph illustrating the relationship between the specific noise level difference at an open point and the dimensionless outer-peripheral-portion average radius of curvature of the rotating blade of the axial flow fan that includes the impeller according to the first embodiment and the full bell mouth. FIG. 15 is a graph illustrating the relationship between the point difference of the fan efficiency at an open point and the dimensionless outer-peripheral-portion average radius of curvature of the rotating blade of the axial flow fan that includes the impeller according to the first embodiment and the full bell mouth. FIG. 16 is a graph illustrating the relationship between the specific noise level difference at a minimum specific noise level and the dimensionless outer-peripheral-portion average radius of curvature of the rotating blade of the axial flow fan that includes the impeller according to the first embodiment and the full bell mouth. FIG. 17 is a graph illustrating the relationship between the point difference of the highest fan efficiency and the dimensionless outer-peripheral-portion average radius of curvature of the rotating blade of the axial flow fan that Includes the impeller according to the first embodiment and the full bell mouth. FIG. 10 to FIG. 17 illustrate the results of an evaluation using the rotating blade 1 with a diameter of 260 mm.

The dimensionless outer-peripheral-portion average radius of curvature is defined by dividing the average radius of curvatures of the blade outer peripheral portion 1*d* by the diameter of the rotating blade 1 in the cross section of the rotating blade 1 of the impeller 3 from the rearward end Fr of the blade leading edge portion to the forward end Rf of the blade trailing edge portion.

The specific noise level $K_\tau$ used in FIG. 10 and FIG. 14 is a calculated value defined by the following equation:

$$K_\tau = SPL_A - 10\ \mathrm{Log}(Q - P_T^{2.5}),$$

where

Q: air volume [$m^3$/min]

$P_\tau$: total pressure [Pa]

$SPL_A$: noise characteristics (after correction A) [dB]

The fan efficiency $E_T$ used in FIG. 11 and FIG. 15 is a calculated value defined by the following equation:

$$E_\tau = (P_T - Q)/(60 - P_W),$$

where

Q: air volume [$m^3$/min]

$P_\tau$: total pressure [Pa]

$P_W$: shaft power [W]

The specific noise level $K_S$ used in FIG. 12 and FIG. 16 is a calculated value defined by the following equation:

$$K_S = SPL_A - 10\ \mathrm{Log}(Q - P_S^{2.5}),$$

where

Q: air volume [$m^3$/min]

$P_S$: static pressure [Pa]

$SPL_A$: noise characteristics (after correction A) [dB]

The fan efficiency $E_S$ used in FIG. 13 and FIG. 17 is a calculated value defined by the following equation:

$$E_S = (P_S - Q)/(60 - P_W),$$

where

Q: air volume [$m^3$/min]

$P_S$: static pressure [Pa]

$P_W$: shaft power [W]

The correction A is to reduce low-frequency sound In accordance with the properties of human hearing. Correction based on the characteristic A defined in JIS C 1502-1990 is an example of the correction A.

Figure 18:
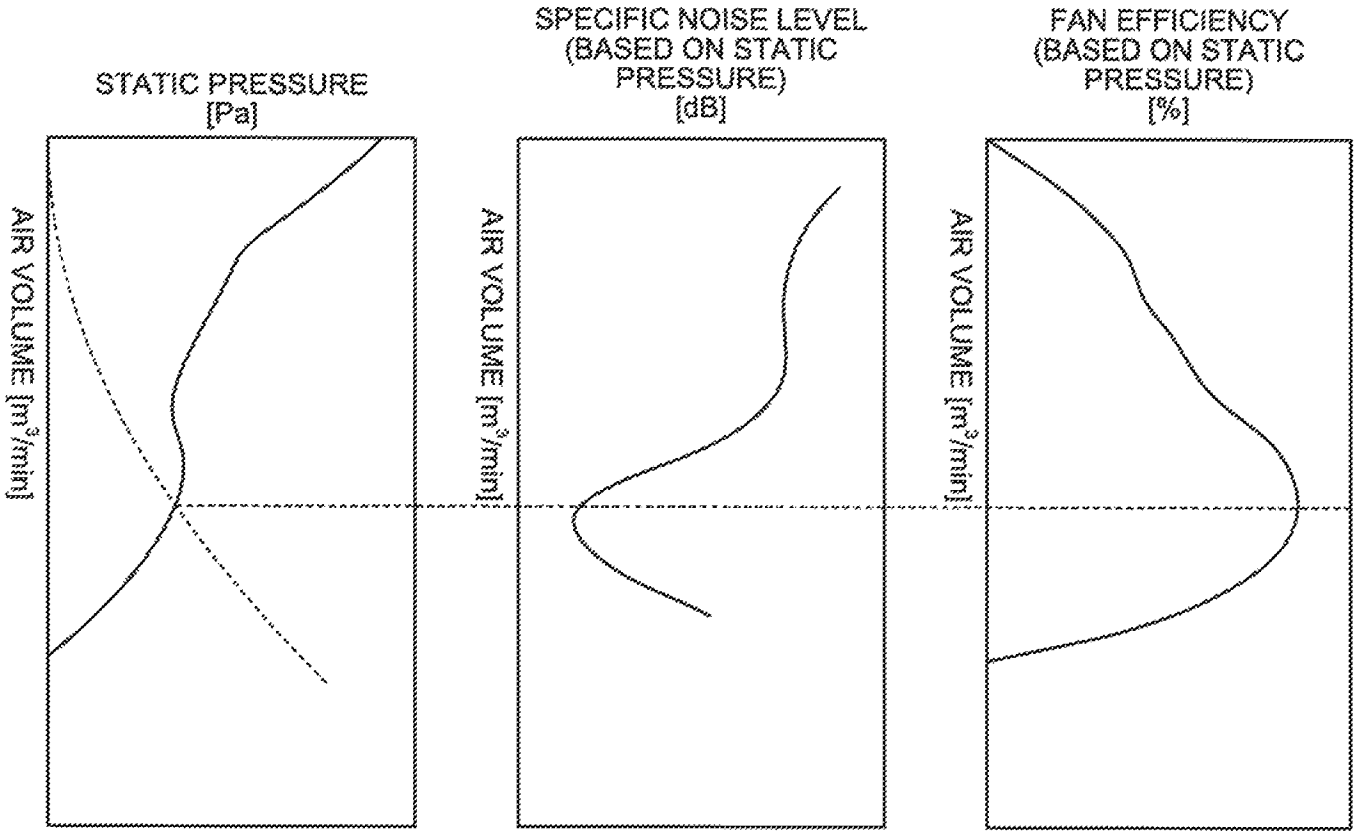
FIG. 18 illustrates graphs representing the relationship between the highest fan efficiency of the fan subjected to a static pressure, the minimum specific noise level, and the air-volume/static-pressure characteristics.

FIG. 18 illustrates graphs of the relationship between the fan efficiency of the fan subjected to a static pressure and the air volume, the relationship between the specific noise level and the air volume, and the relationship between the static pressure and the air volume. The dashed line in the air-volume/static-pressure characteristics in FIG. 18 indicates a pressure loss. It can be seen that when the air volume is close to that at which the static pressure coincides with the pressure loss, the specific noise level is minimum and the fan efficiency is maximum.

As illustrated in FIG. 10 to FIG. 17, it is found that the impeller 3 according to the first embodiment can achieve both noise reduction and high efficiency at any position irrespective of which of the half bell mouth 7 and the full bell mouth 8 is used.

In particular, the impeller according to the first embodiment exhibits a tendency to achieve both noise reduction and high efficiency as the dimensionless outer-peripheral-portion average radius of curvature R2' becomes smaller, and its optimum value is slightly different depending on the form of the bell mouth and the position being compared. It is found that an effect where the specific noise level difference becomes −0.5 dB or lower and the point difference of the fan efficiency becomes +0.5 points or higher is obtained in a region where R2' is smaller than 0.13 at an open point of the half bell mouth as illustrated in FIG. 10 and FIG. 11; in a region where R2' is smaller than 0.145 when the half bell mouth is used and a static pressure is applied as illustrated in FIG. 12 and FIG. 13; in a region where R2' is smaller than 0.145 at an open point of the full bell mouth as illustrated in FIG. 14 and FIG. 15; and in a region where R2' is smaller than 0.13 when the full bell mouth is used and a static pressure is applied as illustrated in FIG. 16 and FIG. 17.

In the impeller 3 according to the first embodiment, the outer concave portion P4 of the rotating blade 1 has a distribution of the radius of curvature value R2 such that it gradually decreases toward the blade trailing edge portion 1*c* from the blade leading edge portion 1*b*. Moreover, the rate of the gradual reduction of the radius of curvature value R2 becomes smaller toward the blade trailing edge portion 1*c*. Consequently, it is possible to reduce an increase in noise and reduce a reduction in efficiency due to the change of the blade tip vortex 5.

The configurations described in the above embodiments are merely examples of the content of the present invention. The configurations can be combined with other well-known technologies, and part of the configurations can be omitted or modified without departing from the scope of the present invention.

REFERENCE SIGNS LIST

1 rotating blade; 1*b* blade leading edge portion; 1*c* blade trailing edge portion; 1*d* blade outer peripheral portion; 1*e* blade inner peripheral portion; 2 boss portion; 3 impeller; 4 rotational axis; 5 blade tip vortex; 7 half bell mouth; 8 full bell mouth; 9 traverse suction flow; 10 intra-blade flow.

The invention claimed is:

1. An impeller comprising:

a boss portion driven to rotate by a motor; and a plurality of rotating blades projecting radially from the boss portion in a direction in which a diameter increases from a rotational axis of the motor and generating airflow in an axial direction of the rotational axis, wherein the rotating blades each have an S-shaped radial cross section in which an inner peripheral side portion is protruded with respect to the airflow and an outer peripheral side portion is recessed with respect to the airflow, and an outer concave portion of the rotating blades, which is a portion between a vertex of an S-shaped portion on the outer peripheral side of the rotating blades and a blade outer peripheral portion, has a distribution of a radius of curvature value such that the radius of curvature value gradually decreases toward a blade trailing edge portion from a blade leading edge portion, wherein a rate of gradual reduction of the radius of curvature value of the recess-shaped portion of the rotating blades becomes smaller toward the blade trailing edge portion.

2. The impeller according to claim 1, wherein the rotating blades are inclined toward an upstream side of the airflow in the blade leading edge portion with an angle of inclination becoming smaller toward the blade trailing edge portion and are inclined toward a downstream side of the airflow in the blade trailing edge portion.

3. An axial flow fan comprising:

the impeller according to claim 2; and a half bell mouth surrounding the rotating blade with the blade leading edge portion uncovered, the half bell mouth raising a pressure of the airflow and regulating the airflow, wherein in a plurality of cross sections of the rotating blade of the impeller starting from a cross section from a rotational center of the impeller through a rearward end of the blade leading edge portion to an outer peripheral edge of the rotating blade and ending at a cross section from the rotational center of the impeller through a forward end of the blade trailing edge portion to the outer peripheral edge of the rotating blade, a value obtained by dividing an average radius of curvature of a blade outer peripheral portion by a diameter of the rotating blade is 0.13 or lower.

4. An axial flow fan comprising:

the impeller according to claim 2; and a full bell mouth surrounding the rotating blade such that the full bell mouth covers the blade leading edge portion from a side, the full bell mouth raising a pressure of the airflow and regulating the airflow, wherein in a plurality of cross sections of the rotating blade of the impeller starting from a cross section from a rotational center of the impeller through a rearward end of the blade leading edge portion to an outer peripheral edge of the rotating blade and ending at a cross section from the rotational center of the impeller through a forward end of the blade trailing edge portion to the outer peripheral edge of the rotating blade, a value obtained by dividing an average radius of curvature of a blade outer peripheral portion by a diameter of the rotating blade is 0.13 or lower.

5. An axial flow fan comprising:

the impeller according to claim 1; and a half bell mouth surrounding the rotating blade with the blade leading edge portion uncovered, the half bell mouth raising a pressure of the airflow and regulating the airflow, wherein in a plurality of cross sections of the rotating blade of the impeller starting from a cross section from a rotational center of the impeller through a rearward end of the blade leading edge portion to an outer peripheral edge of the rotating blade and ending at a cross section from the rotational center of the impeller through a forward end of the blade trailing edge portion to the outer peripheral edge of the rotating blade, a value obtained by dividing an average radius of curvature of a blade outer peripheral portion by a diameter of the rotating blade is 0.13 or lower.

6. An axial flow fan comprising:

the impeller according to claim 1; and a full bell mouth surrounding the rotating blade such that the full bell mouth covers the blade leading edge portion from a side, the full bell mouth raising a pressure of the airflow and regulating the airflow, wherein in a plurality of cross sections of the rotating blade of the impeller starting from a cross section from a rotational center of the impeller through a rearward end of the blade leading edge portion to an outer peripheral edge of the rotating blade and ending at a cross section from the rotational center of the impeller through a forward end of the blade trailing edge portion to the outer peripheral edge of the rotating blade, a value obtained by dividing an average radius of curvature of a blade outer peripheral portion by a diameter of the rotating blade is 0.13 or lower.

7. The impeller according to claim 1, wherein the rotating blades are inclined toward an upstream side of the airflow in the blade leading edge portion with an angle of inclination becoming smaller toward the blade trailing edge portion and are inclined toward a downstream side of the airflow in the blade trailing edge portion.

8. An axial flow fan comprising:

the impeller according to claim 7; and a half bell mouth surrounding the rotating blade with the blade leading edge portion uncovered, the half bell mouth raising a pressure of the airflow and regulating the airflow, wherein in a plurality of cross sections of the rotating blade of the impeller starting from a cross section from a rotational center of the impeller through a rearward end of the blade leading edge portion to an outer peripheral edge of the rotating blade and ending at a cross section from the rotational center of the impeller through a forward end of the blade trailing edge portion to the outer peripheral edge of the rotating blade, a value obtained by dividing an average radius of curvature of a blade outer peripheral portion by a diameter of the rotating blade is 0.13 or lower.

9. An axial flow fan comprising:

the impeller according to claim 7; and a full bell mouth surrounding the rotating blade such that the full bell mouth covers the blade leading edge portion from a side, the full bell mouth raising a pressure of the airflow and regulating the airflow, wherein in a plurality of cross sections of the rotating blade of the impeller starting from a cross section from a rotational center of the impeller through a rearward end of the blade leading edge portion to an outer peripheral edge of the rotating blade and ending at a cross section from the rotational center of the impeller through a forward end of the blade trailing edge portion to the outer peripheral edge of the rotating blade, a value obtained by dividing an average radius of curvature of a blade outer peripheral portion by a diameter of the rotating blade is 0.13 or lower.

* * * * *